US005326103A

United States Patent [19]

Lund et al.

[11] Patent Number: 5,326,103

[45] Date of Patent: Jul. 5, 1994

[54] TURNTABLE AND COVER FOR AMUSEMENT DEVICE

[75] Inventors: John L. Lund, Des Plaines; Joseph E. Kaminkow, Arlington Heights, both of Ill.

[73] Assignee: Data East Pinball, Inc., Melrose Park, Ill.

[21] Appl. No.: 88,751

[22] Filed: Jul. 8, 1993

[51] Int. Cl.[5] ..... A63F 7/30

[52] U.S. Cl. ..... 273/118 R; 273/121 R; 273/121 A; 273/177 R

[58] Field of Search ..... 273/118-125, 273/127, 145 R, 144 R, 145 E, 144 A; 446/241, 475

[56] References Cited

U.S. PATENT DOCUMENTS

| | | | |
|---|---|---|---|
| 3,588,110 | 6/1971 | Hirsch | 273/129 V X |
| 4,455,781 | 6/1984 | Blumenthal | 446/241 |
| 4,858,933 | 8/1989 | Mink | 273/144 B X |
| 5,181,722 | 1/1993 | Krutsch et al. | 273/118 A X |

*Primary Examiner*—Vincent Millin
*Assistant Examiner*—Raleigh W. Chiu
*Attorney, Agent, or Firm*—Gerstman, Ellis & McMillin

[57] ABSTRACT

In an amusement device, for example a pinball game, a rotatable turntable may be provided. A cover has a position for enclosing and retaining a ball rolling on the turntable. A shaft is also provided for raising the cover from that position, to permit the ball to roll outwardly across the periphery of the turntable to another portion of the device. This provides significant variation in the play of the amusement device in that the ball can leave the turntable in any horizontal direction to provide great variation in play of the ball.

14 Claims, 2 Drawing Sheets

TURNTABLE AND COVER FOR AMUSEMENT DEVICE

BACKGROUND OF THE INVENTION

In amusement devices such as pinball machines there is significant advantage by providing variety and unpredictability of play. To this end, in a previous pinball game known as Turtles, manufactured by Data East Pinball, Inc. a spinning turntable was provided flush with the playfield to provide a change in direction of motion of balls rolling on the playfield.

By this invention, further unpredictability and unexpected action is provided to a spinning turntable for pinball or any other amusement device, in which balls may be captured on the turntable, to rotate rather in the manner of a ball on a roulette wheel, until released by a predetermined event taking place in the device, or if desired by the specific control of the player.

DESCRIPTION OF THE INVENTION

In accordance with this invention, an amusement device such as a pinball machine carries a rotatable turntable. The turntable may be positioned above the playfield of the pinball machine, but it also may be flush with the playfield or even below it, as may be desired.

A typically transparent cover is provided, having a position for enclosing and retaining a ball which is rolling on the turntable. Thus, when the cover is in that enclosing position, the ball is captured on the turntable, and rolls, typically in an orbital manner, around the turntable as the turntable rotates.

Means are provided for raising the cover from the retaining position, to permit the ball to roll outwardly across the periphery of the turntable to another portion of the device, for example the remainder of the playfield. Thus, the future course of rolling of the ball depends strongly on the precise timing of the raising of the cover, since the ball will tend to orbit the center of rotation of the turntable (if the turntable is horizontal), and will immediately roll outwardly across the periphery of the turntable as the cover is raised.

Thus, the ball can roll outwardly in any direction from the turntable, depending upon the timing of the raising of the cover. This of course can affect the course of action of the amusement device as the ball rolls in any of a large number of different directions.

Typically, the cover is substantially hemispherical, optionally having a reinforcing band secured to the hemispherical cover at its circular edge. Also, the cover may define a ball-receiving aperture which is typically spaced above the turntable in both of the above-described positions of the cover. The purpose of this aperture is to feed balls to the turntable while preventing balls on the turntable from rolling back through the aperture. A trough may be positioned outside of the cover to feed balls to the aperture. In a pinball game, the trough may receive balls from another station on the pinball machine.

Thus, by this invention a new dimension is provided to an amusement device, in that the rotatable turntable assembly may capture one or more rolling balls until they are released by raising of the cover. This signal for release may actuate a solenoid to cause cover raising, with the actuation signal being caused by some event taking place on the pinball playfield, for example. Alternatively, the player may manually give the signal, which turns the amusement device more into a game of skill, with the ball being launched from the turntable at the players volition, as the player attempts to place the ball on a predetermined rolling path. Energy may be imparted to the ball by the rolling turntable, so that the turntable functions as an auxiliary shooter, which is actuated by lifting of the cover for a new game of motion and skill.

Also, in accordance with this invention, a method is provided for forming a substantially hemispherical structure, for example the cover used in accordance with this invention. The method comprises: laying a substantially flat sheet of thermoformable plastic across a ring of material that retains its shape under thermoforming conditions for the plastic. One then presses a central portion of the plastic sheet with fluid pressure at a thermoforming temperature through the ring to form the substantially hemispherical structure. Such pressing may be with simple air pressure, either by suction of a vacuum on one side of the ring, or by providing pressurized air on the other side of the ring, so that the heat-softened plastic stretches through the ring to form a substantially hemispherical bubble. This typically takes place without the need for a die to define the shape of the bubble, which forms spontaneously.

In the process the ring, which is preferably a metal band with ends connected together with a dove tail connection, preferably becomes attached to the plastic sheet. Thereafter, plastic sheet portions substantially outside of the ring may be removed.

Following this, for purposes of this invention, an aperture may be cut in the substantially hemispherical structure to provide a preferred cover in accordance with this invention.

DESCRIPTION OF THE DRAWINGS

Referring to the drawings.

DESCRIPTION OF SPECIFIC EMBODIMENTS

Figure 1:
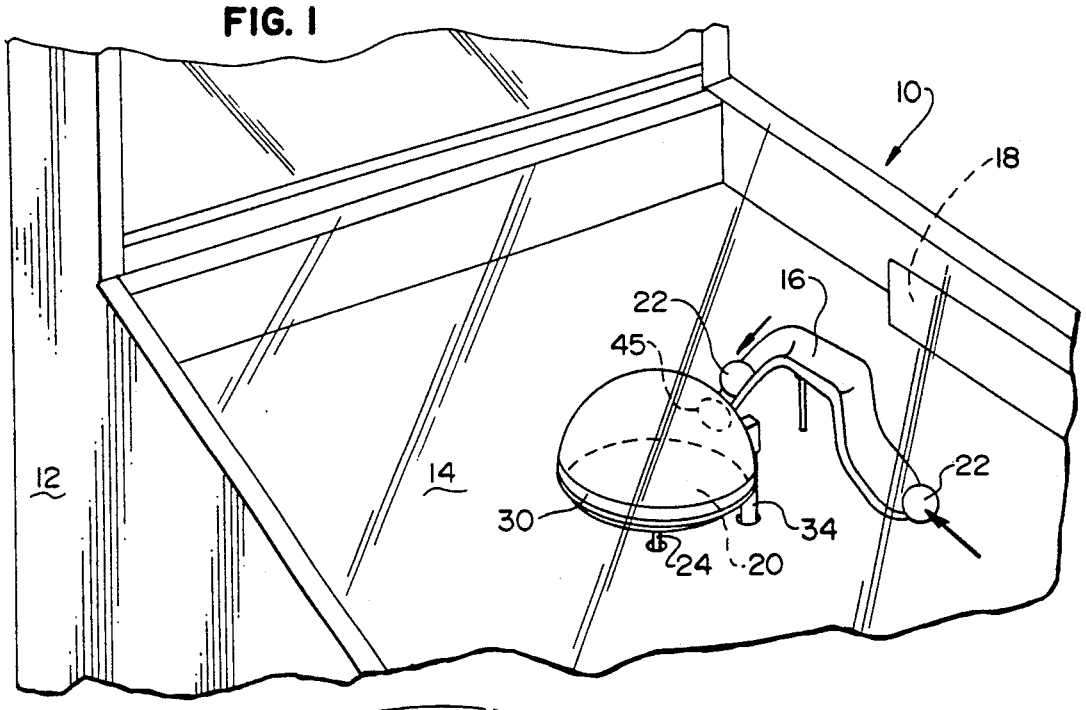
FIG. 1 is a fragmentary perspective view of a pinball machine incorporating the device of this invention.

Referring to the drawings, FIG. 1 shows a pinball machine 10 having a standard frame 12 which carries a playfield 14. A ball shooter is provided with a trough 18 in conventional manner to launch balls onto the playfield. See for example Kaminkow et al. U.S. Pat. No. 5,048,832.

The playfield 14 may have differing elevations, particularly, a raised trough 16 for ball travel.

As part of the play scheme in accordance with this invention, a turntable 20 is provided in a position projecting above playfield 14 so that balls 22 can roll under the playfield. However, if desired, turntable 20 may be flush with the playfield, or even recessed in the playfield.

Turntable 20 is supported by a vertical shaft 24 which extends through playfield 14, shaft 24 and turntable 20 being rotated by motor M.

In accordance with this invention, a cover 28 is provided over turntable 20 for enclosing and retaining a ball 22*a* which is carried on turntable 20 in rolling relation therewith. In this specific embodiment, cover 28 may be substantially hemispherical in shape and made of transparent plastic except for metal supporting band 30, which reinforces the circular edge 32 of hemispherical cover 28, defining an open mouth within band 30.

Figure 2:
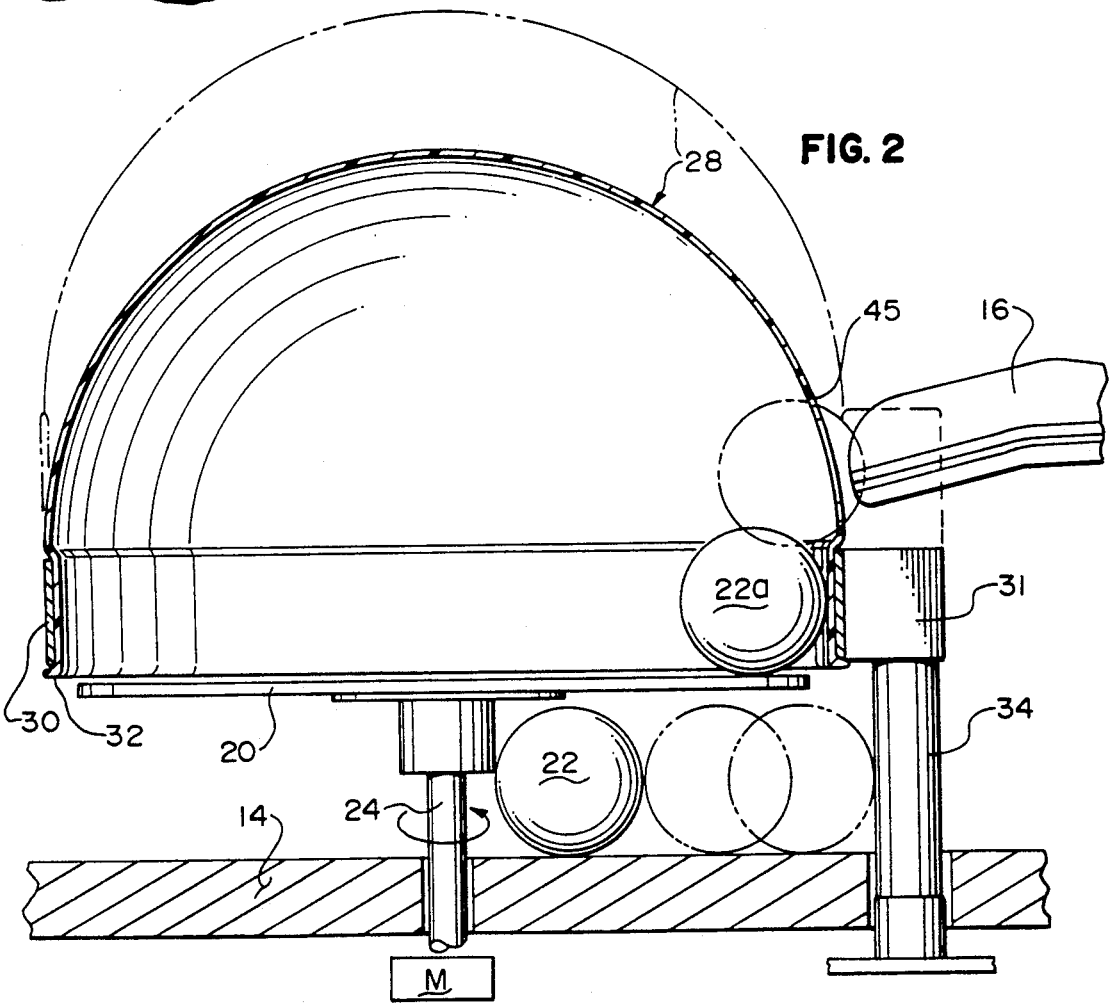
FIG. 2 is an elevational view, taken partly in section, showing details of the device of this invention.
Figure 3:
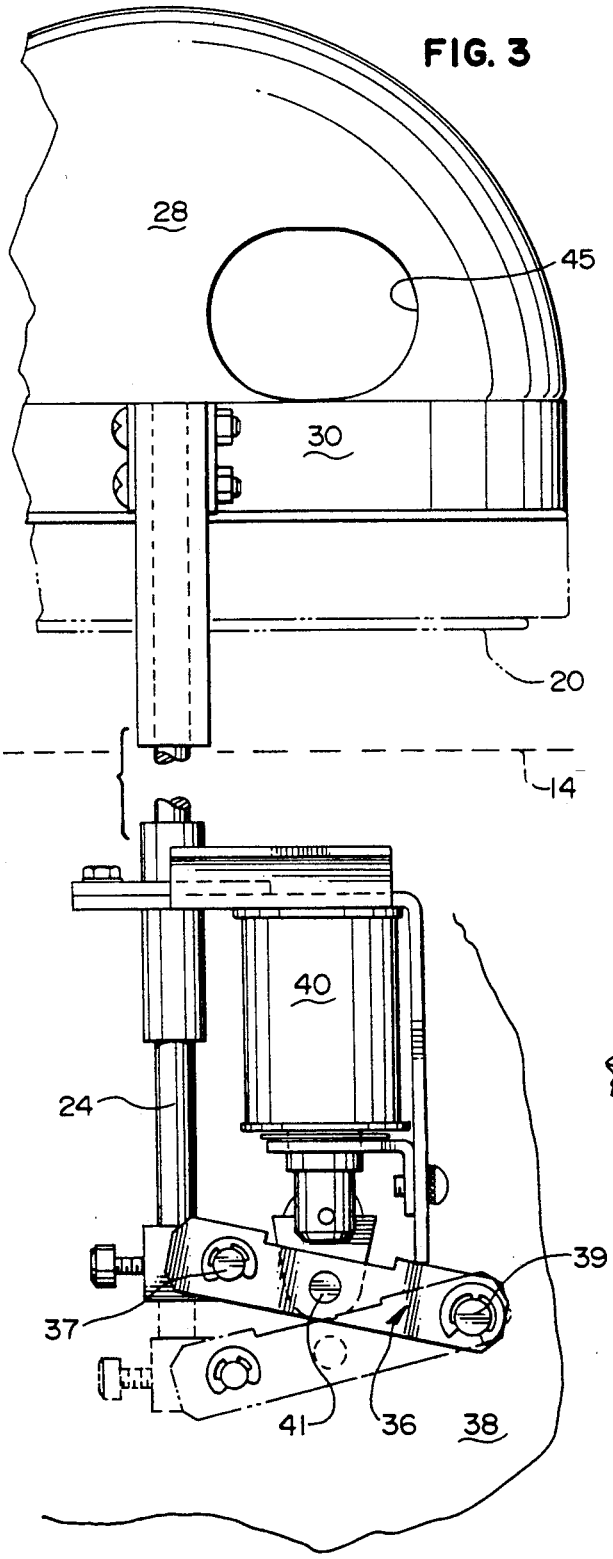
FIG. 3 is a fragmentary elevational view, taken partly in section, showing the turntable and cover of this invention, plus the mechanism for raising and lowering the cover.

Band 30 may also define a looped portion 31, to be connected to vertical rod 34, which also extends through an aperture in playfield 14 and connects at its lower end with a pivot pin 36 (FIG. 3) in pivoting relation therewith. At an end of pivot pin 36, opposed to its connection 37 with rod 24, pin 36 is pivotally connected to a frame 38 with a second pivot 39. Solenoid 40 has an operating rod pivotally connected to a central portion 41 of pivot pin 36, so that operation of solenoid 40 can raise cover 28 from its enclosing, ball-retaining position, shown in full lines in FIG. 2, to a ball-releasing position, shown in dotted lines in FIG. 2 and full lines in FIG. 3. Cover 28 is elevated by a distance sufficient to allow the ball or balls 22*a* carried on turntable 20 to roll outwardly across the periphery thereof, to fall down onto playfield 14 for further play action.

This happens particularly when turntable 20 is being rotated by motor M. In such a circumstance, when cover 28 is in its lower position shown in full lines in FIG. 2, balls 22*a* tend to orbit about with the rotating turntable, being retained adjacent the periphery of turntable 20 by cover 28. Then, when cover 28 is raised, balls 22*a* immediately fly off of the turntable in a direction dependent upon their particular position at the moment of cover raising, to provide a wide variety of game play action, as the balls 22*a* fall at different positions and directions of motion onto playfield 14.

Cover 28 may carry an aperture 45, which communicates with a sloped trough 16 when cover 28 is in its lower, ball-retaining position. Thus, in this position, cover 28, which does not rotate, may receive balls from trough 16, which balls pass through aperture 45 and fall onto the rotating turntable 20 in play action. There the balls are retained, until cover 28 is lifted. This lifting action may be due to any event that takes place on the playfield such as a desired score or the striking of a special target, by the user of a microprocessor 44 to control the action of solenoid 40.

Also, solenoid 40 may be manually activated if desired to raise cover 28, turning the game more into a game of skill as one "aims" the motion of balls 22 as cover 28 is lifted, particularly if turntable 20 is spinning rather rapidly.

Thus, an amusement device and particularly a pinball game can be provided with a new form of play action by means of the use of a cover in conjunction with a spinning turntable in accordance with this invention, to provide scattering distribution of balls off of the turntable in typically any horizontal direction.

The specific embodiment of the cover 28 and retaining band 30 may be made in accordance with this invention by laying a substantially flat sheet of thermoformable plastic across a ring of material such as circular metal band 30. Then, in a conventional vacuum forming apparatus, one simply heats the plastic to thermoforming conditions for the plastic, and presses with fluid pressure or suction a central portion of the plastic sheet at the appropriate thermoforming pressure through the ring to form the substantially hemispherical cover 28. The fluid pressure provided may typically either be created by evacuation of one side of the ring in the thermoforming die, or by providing additional air pressure on the other side, for example a suction pressure of 15 to 20 psia. By this invention, a plastic bubble corresponding to cover 28 forms in substantially hemispherical shape without the need for a reinforcing or backing die to help define the hemispherical shape. It forms spontaneously. Then, upon cooling, the cover of this invention is formed.

Also, particularly when metal ring 30 is a band of flat metal, the plastic typically bonds with the metal band, typically a mostly mechanical attachment where band 30 is captured at its top and bottom edges. Metal band 30 reinforces the open edge of the hemispherical cover. Then, if desired, the plastic material which is outside of the ring 48 may be cut away to provide the cover of this invention.

Figure 4:
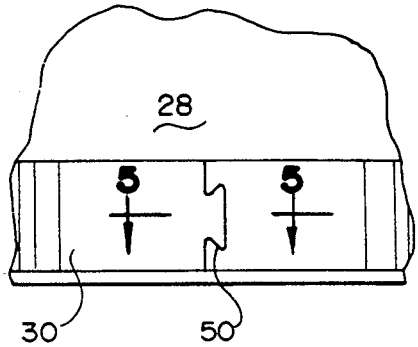
FIG. 4 is a fragmentary elevational view of a portion of the cover of the previous drawings.
Figure 5:
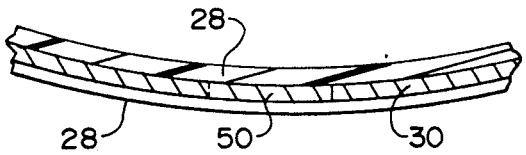
FIG. 5 is a sectional view taken along line 5—5 of FIG. 4.

The circular metal band 30 may be connected together with abutting ends as shown in FIGS. 4 and 5 by means of a dove tail connection 50 as shown, with spot welding or gluing if desired to hold the bands together in such end-abutting relation.

Specifically, the flat plastic used may be PETG, for example sold by the Eastman Chemical Co., initially having a thickness of about 1/16 to ¼ inch. The diameter of circular metal band 30 may be 5–6 inches, to form a hemispherical cover 28 of similar diameter by such thermoforming at a plastic temperature of 180° to 210° F.

The above has been offered for illustrative purposes only, and is not intended to limit the scope of the invention of this application, which is as defined in the claims below.

That which is claimed is:

1. In an amusement device, a rotatable turntable; a transparent cover having a position for enclosing and retaining a ball rolling on said turntable; and means for raising said cover from said position, to permit said ball to roll outwardly across the periphery of said turntable to another portion of said device.

2. The device of claim 1 in which said cover defines a ball-receiving aperture, said aperture being spaced above said turntable to prevent balls on said turntable from rolling through said aperture.

3. The device of claim 2 in which a chute outside of said cover feeds balls to said aperture.

4. The device of claim 1 in which said cover is substantially hemispherical.

5. A pinball machine which comprises a frame that carries a playfield, and means for launching balls on said playfield, said pinball machine having with said playfield a rotatable turntable; a cover having a position for enclosing and retaining a ball rolling on said turntable; and means for raising said cover from said position, to permit said ball to roll outwardly across the periphery of said turntable to another portion of said device.

6. The pinball machine of claim 5 in which said turntable is positioned above the playfield, to allow said ball that rolls outwardly across the periphery to fall onto the playfield.

7. The pinball machine of claim 5 in which said cover is transparent.

8. The pinball machine of claim 6 in which said cover defines a ball-receiving aperture said aperture being spaced above said turntable to feed balls to said turntable, and to prevent balls on said turntable from rolling through said aperture, in which a chute outside of said cover feeds balls to said aperture.

9. The pinball machine of claim 6 in which said cover is substantially hemispherical.

10. In an amusement device, a rotatable turntable; a transparent cover having a position for enclosing and retaining a ball rolling on said turntable; said cover defining a ball-receiving aperture, said aperture being spaced above said turntable to feed balls to said turntable and to prevent balls on said turntable from rolling through said aperture; a chute outside of said cover feeding balls to said aperture; and means for raising said cover from said position to permit said ball to roll outwardly across the periphery of said turntable to another portion of said device.

11. The device of claim 10 in which said cover is substantially hemispherical.

12. In an amusement device, a rotatable turntable; a substantially hemispherical cover having a position for enclosing and retaining a ball rolling on said turntable; and means for raising said cover from said position, to permit said ball to roll outwardly across the periphery of said turntable to another portion of said device.

13. The device of claim 12 in which said cover defines a ball receiving aperture, said aperture being spaced above said turntable to prevent balls on said turntable from rolling through said aperture.

14. The device of claim 13 in which a chute outside of said cover feeds balls to said aperture.

* * * * *